US007048359B2

(12) United States Patent
Keefe et al.

(10) Patent No.: US 7,048,359 B2
(45) Date of Patent: May 23, 2006

(54) INK-JET PRINTHEAD AND METHOD FOR PRODUCING THE SAME

(75) Inventors: Brian J. Keefe, La Jolla, CA (US); Ali Emamjomeh, San Diego, CA (US); Roger J. Kolodziej, Corvallis, OR (US); Michael J. Regan, Corvallis, OR (US); Harold Lee Van Nice, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/459,864

(22) Filed: Jun. 11, 2003

(65) Prior Publication Data

US 2003/0210302 A1 Nov. 13, 2003

Related U.S. Application Data

(60) Division of application No. 08/938,346, filed on Sep. 26, 1997, now Pat. No. 6,659,596, which is a continuation of application No. 08/922,272, filed on Aug. 28, 1997, now Pat. No. 6,062,679.

(51) Int. Cl.
*B41J 2/05* (2006.01)

(52) U.S. Cl. ..... 347/63; 347/62

(58) Field of Classification Search ..... 347/63, 347/64, 20, 56, 51, 61–65, 67; 216/27; 427/450, 427/577, 590, 122, 249.7, 249.8, 249.1, 902
See application file for complete search history.

(56) References Cited

U.S. PATENT DOCUMENTS

| | | | | |
|---|---|---|---|---|
| 4,990,939 | A * | 2/1991 | Sekiya et al. | 347/62 |
| 5,187,500 | A | 2/1993 | Bohorquez et al. | 347/57 |
| 5,317,346 | A * | 5/1994 | Garcia | 347/63 |
| 5,464,667 | A * | 11/1995 | Kohler et al. | 427/577 |
| 5,474,808 | A * | 12/1995 | Aslam | 427/249.9 |
| 5,485,185 | A | 1/1996 | Sueoka et al. | 347/64 |
| 5,804,083 | A * | 9/1998 | Ishii et al. | 216/2 |
| 5,812,158 | A * | 9/1998 | Murthy et al. | 347/45 |
| 6,126,276 | A * | 10/2000 | Davis et al. | 347/65 |
| 6,561,632 | B1 * | 5/2003 | Feinn et al. | 347/65 |

FOREIGN PATENT DOCUMENTS

WO WO 95/20253 7/1995

OTHER PUBLICATIONS

Properties of diamond like carbon, Robertson, J., Surafce and Coatings Technology, 50 (1992), pp. 185-203).*
Hewlett-Packard Journal, May 1985, pp. 3-40.
Hewlett-Packard Journal, Oct. 1988, pp. 51-98.
Hewlett-Packard Journal, Aug. 1992, pp. 64-92.

(Continued)

*Primary Examiner*—Juanita D. Stephens

(57) ABSTRACT

An ink-jet printhead is provided having a thin film substrate comprising a plurality of thin film layers; a plurality of ink firing heater resistors defined in said plurality of thin film layers; a polymer fluid barrier layer; and a carbon rich layer disposed on said plurality of thin film layers, for bonding said polymer fluid barrier layer to said thin film substrate.

15 Claims, 6 Drawing Sheets

OTHER PUBLICATIONS

Hewlett-Packard Journal, Dec. 1992, pp. 6-15.
Hewlett-Packard Journal, Feb. 1994, pp. 6-97.
R.E. Shroder, et al, "Analysis of the composite structures in diamond thin films by Raman spectroscopy", Physical Review B, V. 41(6), Feb. 15, 1990.
M. Weiler et al; "Preparation and properties of highly tetrahedral hydrogenated amorphous carbon", Physical Review B, V. 53(3), Jan. 15, 1996.
M.A. Tamor et al; "Atomic constraint in hydrogenated "diamond-like" carbon", Appl. Phys Letter V. 58(6), Feb. 11, 1991.
J. Robertson, "Properties of diamond-like carbon—Review", Surface and Coatings Technology, V. 50(1992), pp. 185-203.
"Dylyn: A novel coating with unique properties", Advanced Refractory Technologies, Ph (716)875-4091.
M.C. Turchan, "Brillant * Discovery", QQC, Inc. May 13, 1996, pp. 1-11.
B. Ollivier et al, "Adhesion of diamond-like carbon films on polymers: an assessment of the validity of the scratch test technique applied to flexible substrates", Surface Engineering , Nov. 16, 1993.

* cited by examiner

INK-JET PRINTHEAD AND METHOD FOR PRODUCING THE SAME

RELATED APPLICATIONS

This application is a divisional of U.S. application Ser. No. 08/938,346, filed on Sep. 26, 1997, now U.S. Pat. No. 6,659,596, which is a continuation in part of U.S. application Ser. No. 08/922,272, filed on Aug. 28, 1997, now U.S. Pat. No., 6,062,679.

FIELD OF INVENTION

The present invention generally relates to a printhead for ink-jet printers, and, more particularly, to a printhead having improved adhesion between substrate and barrier layer.

BACKGROUND OF INVENTION

The art of ink-jet printing is relatively well developed. Commercial products such as computer printers, graphics plotters, and facsimile machines have been implemented with ink-jet technology for producing printed media. The contributions of Hewlett-Packard Company to ink-jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally an ink-jet image is formed when a precise pattern of dots is ejected from a drop-generating device known as a "printhead" onto a printing medium. Typically, an ink-jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink-jet printhead includes an array of precisely formed nozzles in an orifice plate that is attached to a thin film substrate that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substrate the orifice plate that are adjacent the ink chambers.

The thin film substrate is typically comprised of a substrate such as silicon on which are formed various thin film layers that form thin film ink firing resistors, apparatus for enabling the resistors, and also interconnections to bonding pads that are provided for external electrical connections to the printhead. The thin film substrate more particularly includes a top thin film layer of tantalum disposed over the resistors as a thermomechanical passivation layer.

The ink barrier layer is typically a polymer material that is laminated as a dry film to the thin film substrate, and is designed to be photo-definable and both UV and thermally curable.

An example of the physical arrangement of the orifice plate, ink barrier layer, and thin film substrate is illustrated at page 44 of the *Hewlett-Packard Journal* of February 1994, cited above. Further examples of ink-jet printheads are set forth in commonly assigned U.S. Pat. No. 4,719,477 and U.S. Pat. No. 5,317,346, both of which are incorporated herein by reference.

Considerations with the foregoing ink-jet printhead architecture include delamination of the orifice plate from the ink barrier layer, and delamination of the ink barrier layer from the thin film substrate. Delamination principally occurs from environmental moisture and the ink itself which is in continual contact with the edges of the thin film substrate/barrier interface and the barrier/orifice plate interface in the drop generator regions.

While the barrier adhesion to tantalum (the adhesion occurring between the barrier layer and the native oxide layer which forms on the tantalum layer) has proven to be sufficient for printheads that are incorporated into disposable ink-jet cartridges, barrier adhesion to tantalum is not sufficiently robust for semi-permanent ink-jet printheads which are not replaced as frequently. Moreover, new developments in ink chemistry have resulted in formulations that more aggressively debond the interface between the thin film substrate and the barrier layer, as well as the interface between the barrier layer and the orifice plate.

In particular, a solvent, such as water, from the ink enters the thin film substrate/barrier interface and the barrier/orifice plate by penetration through the bulk of the barrier, penetration along the barrier, and in the case of a polymeric orifice plate by penetration through the bulk of the polymeric orifice plate, causing debonding of the interfaces through a chemical mechanism such as hydrolysis.

The problem with tantalum as a bonding surface is due to the fact that while the tantalum layer is pure tantalum when it is first formed in a sputtering apparatus, a tantalum oxide layer forms as soon as the tantalum layer is exposed to an oxygen containing atmosphere. The chemical bond between an oxide and a polymer film tends to be easily degraded by water, since the water forms a hydrogen bond with the oxide that competes with and replaces the original polymer to oxide bond, and thus ink formulations, particularly the more aggressive ones, debond an interface between a metal oxide and a polymer barrier.

Thus, it would be advantageous to provide an improved ink-jet printhead that with improved adhesion between the thin film substrate and the ink barrier layer.

DISCLOSURE OF THE INVENTION

In accordance with the present invention an ink-jet printhead is provided having a thin film substrate comprising a plurality of thin film layers; a plurality of ink firing heater resistors defined in said plurality of thin film layers; a polymer fluid barrier layer; and a carbon rich layer disposed on said plurality of thin film layers, for bonding said polymer fluid barrier layer to said thin film substrate.

DETAILED DESCRIPTION OF THE INVENTION

Figure 1:
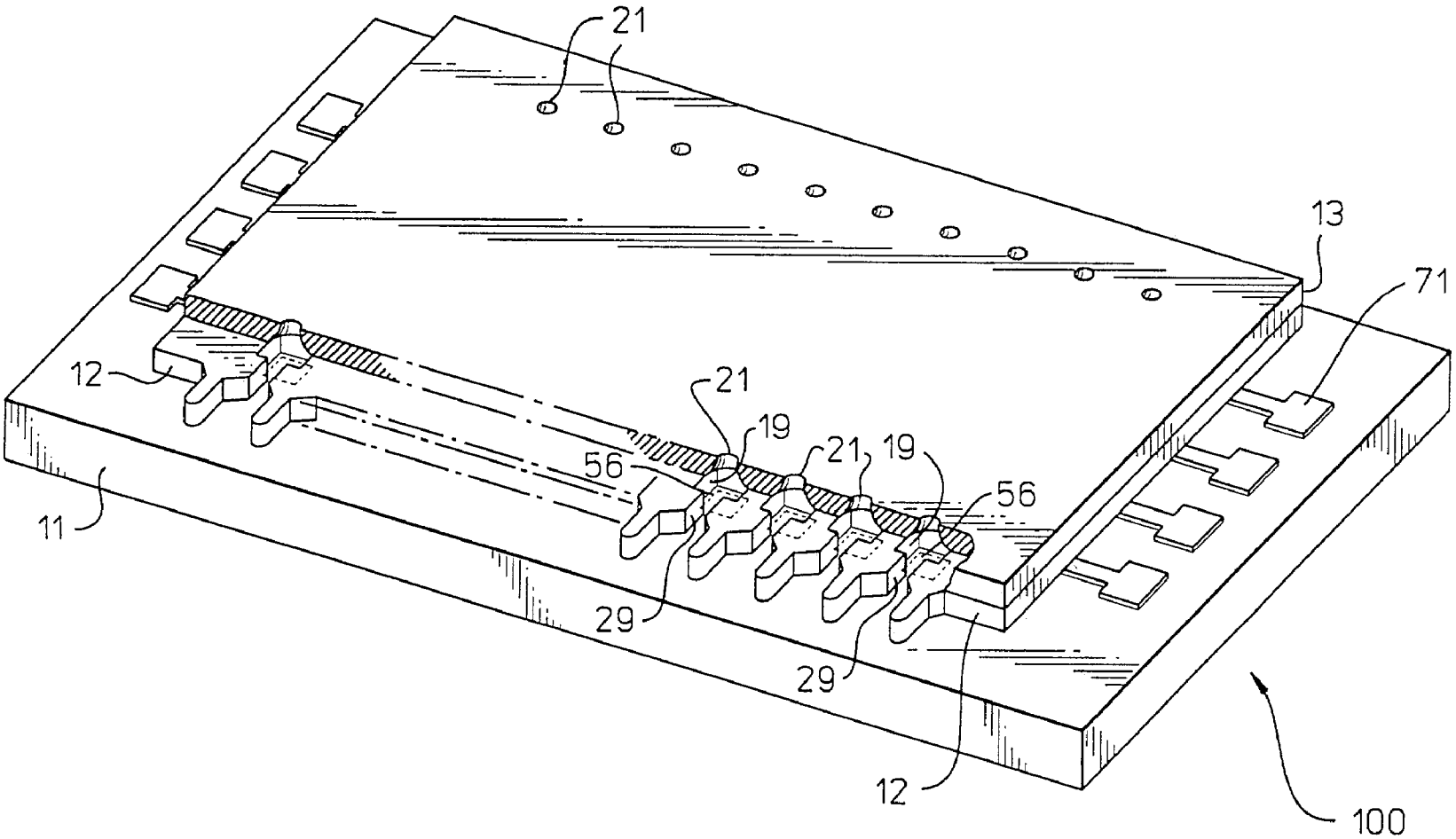
FIG. 1 is a schematic, partially sectioned perspective view of an ink-jet printhead in accordance with the invention.

Referring now to FIG. 1, set forth therein is an unscaled schematic perspective view of an ink jet printhead 100 in which the invention can be employed and which generally includes (a) a thin film substrate or die 11 comprising a substrate such as silicon and having various thin film layers formed thereon, (b) an ink barrier layer 12 disposed on the thin film substrate 11, and (c) an orifice or nozzle plate 13 attached to the top of the ink barrier 12.

The thin film substrate 11 is formed pursuant to integrated circuit fabrication techniques, and includes thin film heater resistors 56 formed therein. By way of illustrative example, the thin film heater resistors 56 are located in rows along longitudinal edges of the thin film substrate.

The ink barrier layer 12 is formed of a dry film that is heat and pressure laminated to the thin film substrate 11 or a wet dispensed liquid cast film that is subsequently spun to uniform thickness and dried by driving off excess solvent. The barrier layer 12 is photo defined to form therein ink chambers 19 and ink channels 29 which are disposed over resistor regions which are on either side of a generally centrally located gold layer 62 (FIG. 2) on the thin film substrate 11. Gold bonding pads 71 engagable for external electrical connections are disposed at the ends of the thin film substrate 11 and are not covered by the ink barrier layer 12. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the Riston brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise, by way of further example, a plated metal such as nickel.

The ink chambers 19 in the ink barrier layer 12 are more particularly disposed over respective ink firing resistors 56, and each ink chamber 19 is defined by the edge or wall of a chamber opening formed in the barrier layer 12. The ink channels 29 are defined by further openings formed in the barrier layer 12, and are integrally joined to respective ink firing chambers 19. By way of illustrative example, FIG. 1 illustrates an outer edge fed configuration wherein the ink channels 29 open towards an outer edge formed by the outer perimeter of the thin film substrate 11 and ink is supplied to the ink channels 29 and the ink chambers 19 around the outer edges of the thin film substrate, for example as more particularly disclosed in commonly assigned U.S. Pat. No. 5,278,584, incorporated herein by reference. The invention can also be employed in a center edge fed ink jet printhead such as that disclosed in previously identified U.S. Pat. No. 5,317,346, wherein the ink channels open towards an edge formed by a slot in the middle of the thin film substrate.

The orifice plate 13 includes orifices 21 disposed over respective ink chambers 19, such that an ink firing resistor 56, an associated ink chamber 19, and an associated orifice 21 are aligned. An ink drop generator region is formed by each ink chamber 19 and portions of the thin film substrate 11 and the orifice plate 13 that are adjacent the ink chamber 19.

Figure 2:
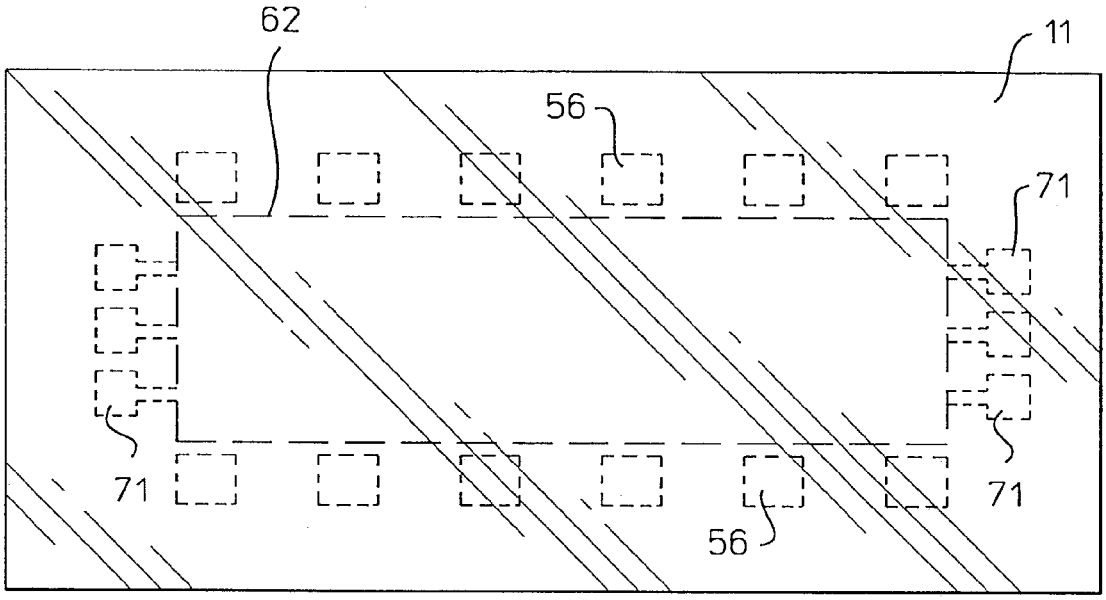
FIG. 2 is an unscaled schematic top plan illustration of the general layout of the thin film substrate of the ink-jet printhead of FIG. 1.

Referring now to FIG. 2, set forth therein is an unscaled schematic top plan illustration of the general layout of the thin film substrate 11. The ink firing resistors 56 are formed in resistor regions that are adjacent the longitudinal edges of the thin film substrate 11. A patterned gold layer 62 comprised of gold traces forms the top layer of the thin film structure in a gold layer region 62 located generally in the middle of the thin film substrate 11 between the resistor regions and extending between the ends of the thin film substrate 11. Bonding pads 71 for external connections are formed in the patterned gold layer 62, for example adjacent the ends of the thin film substrate 11. The ink barrier layer 12 is defined so as to cover all of the patterned gold layer 62 except for the bonding pads 71, and also to cover the areas between the respective openings that form the ink chambers and associated ink channels. Depending upon implementation, one or more thin film layers can be disposed over the patterned gold layer 62.

Figure 3:
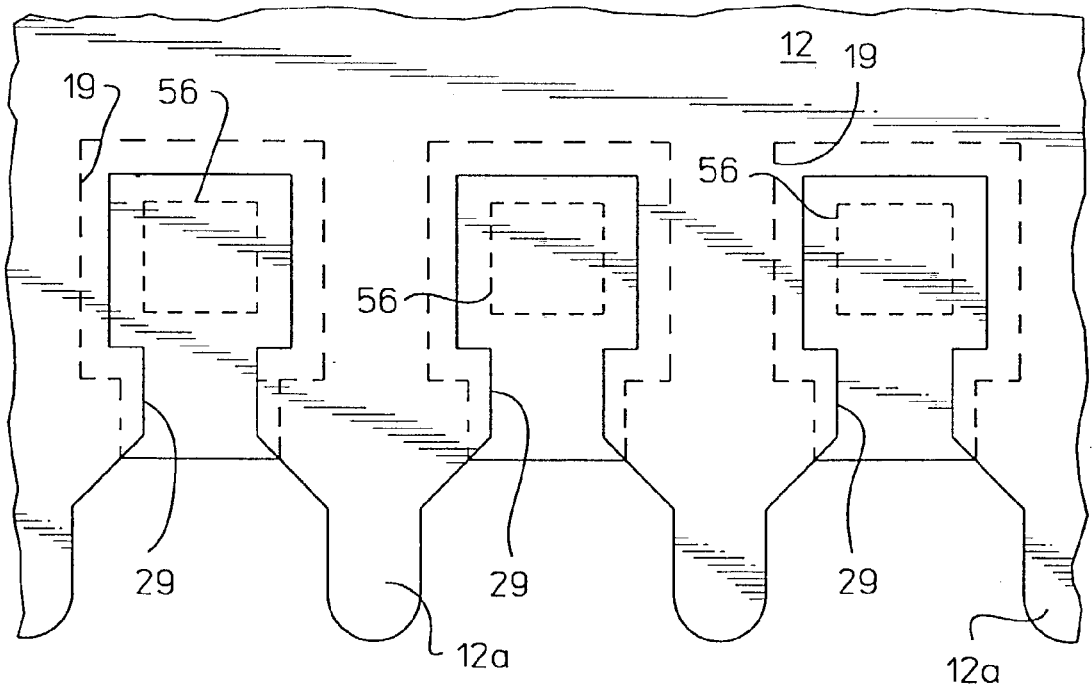
FIG. 3 is an unscaled schematic top plan view illustration the configuration of a plurality of representative heater resistors, ink chambers, and associated ink channels.

Referring now to FIG. 3, set forth therein is an unscaled schematic top plan view illustrating the configuration of a plurality of representative heater resistors 56, ink chambers 19 and associated ink channels 29. As shown in FIG. 3, the heater resistors 56 are polygon shaped (e.g., rectangular) and are enclosed on at least two sides thereof by the wall of an ink chamber 19 which for example can be multi-sided. The ink channels 29 extend away from associated ink chambers 19 and can become wider at some distance from the ink chambers 19. Ink chambers 19 and associated ink channels 29 are formed by an array of side by side barrier tips 12 a that extend from a central portion of the ink barrier 12 toward a feed edge of the thin film substrate 11.

In accordance with the invention, the thin film substrate 11 includes a carbon rich layer 63, more specifically a diamond like carbon (DLC) layer, (FIG. 4) that may be patterned, functioning as an adhesion layer for the ink barrier layer 12. The DLC layer 63 is defined so as to cover the entire patterned gold layer 62 except for the bonding pads 71.

Figure 4:
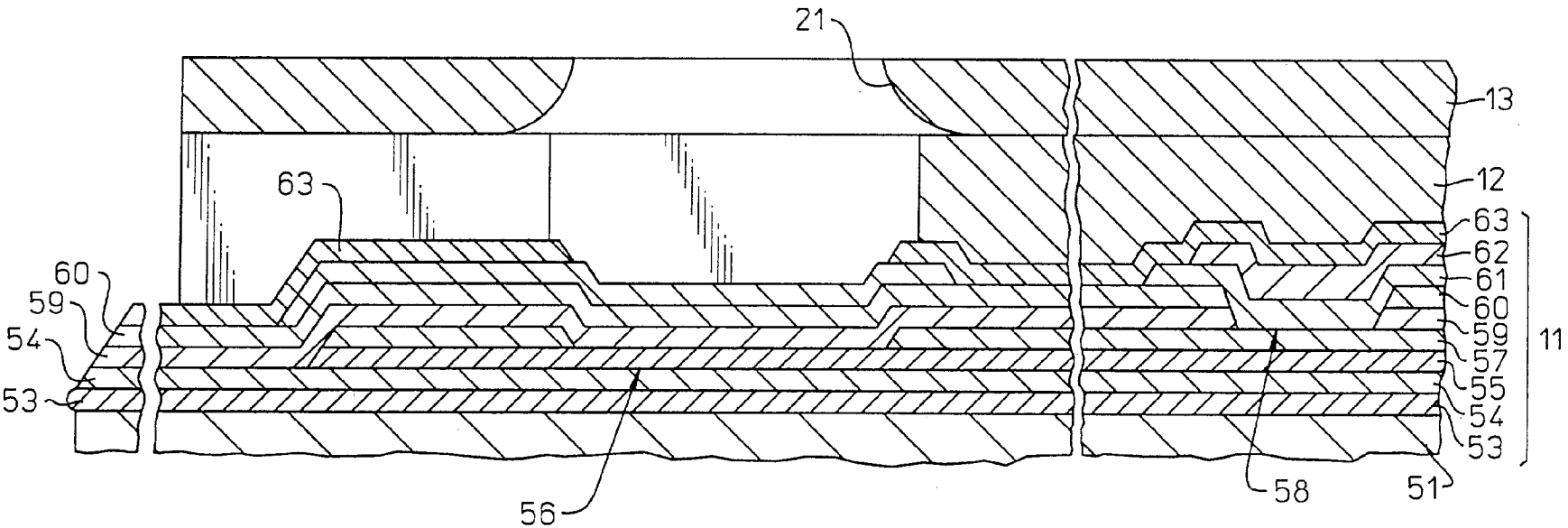
FIG. 4 is an unscaled schematic cross sectional view of the ink-jet printhead of FIG. 1 taken laterally through a representative ink drop generator region and illustration an embodiment of the printhead of FIG. 1.

Referring now to FIG. 4, set forth therein is an unscaled schematic cross sectional view of the ink jet printhead of FIG. 1 taken through a representative ink drop generator region and a portion of the centrally located gold layer region 62, and illustrating a specific embodiment of the thin film substrate 11. The thin film substrate 11 of the ink jet printhead of FIG. 4 more particularly includes a silicon substrate 51, a field oxide layer 53 deposited over the silicon substrate 51, and a patterned phosphorous doped oxide layer 54 disposed over the field oxide layer 53. A resistive layer 55 comprising tantalum aluminum is formed on the phosphorous oxide layer 54, and extends over areas where thin film resistors, including ink firing resistors 56, are to be formed beneath ink chambers 19. A patterned metallization layer 57 comprising aluminum doped with a small percentage of copper and/or silicon, for example, is disposed over the resistive layer 55.

The metallization layer 57 comprises metallization traces defined by appropriate masking and etching. The masking and etch of the metallization layer 57 also defines the resistor areas. In particular, the resistive layer 55 and the metallization layer 57 are generally in registration with each other, except that portions of traces of the metallization layer 57 are removed in those areas where resistors are formed. A resistor area is defined by providing first and second metallic traces that terminate at different locations on the perimeter of the resistor area. The first and second traces comprise the terminal or leads of the resistor which effectively include a portion of the resistive layer that is between the terminations of the first and second traces. Pursuant to this technique of forming resistors, the resistive layer 55 and the metallization layer can be simultaneously etched to form patterned layers in registration with each other. Then, openings are etched in the metallization layer 57 to define resistors. The ink firing resistors 56 are thus particularly formed in the resistive layer 55 pursuant to gaps in traces in the metallization layer 57.

A composite passivation layer comprising a layer 59 of silicon nitride ($Si_3N_4$) and a layer 60 of silicon carbide (SiC) is deposited over the metallization layer 57, the exposed portions of the resistive layer 55, and exposed portions of the oxide layer 53. A tantalum passivation layer 61 is deposited on the composite passivation layer 59, 60 over the ink firing resistors 56. The tantalum passivation layer 61 can also extend to areas over which the patterned gold layer 62 is formed for external electrical connections to the metallization layer 57 by conductive vias 58 formed in the composite passivation layer 59, 60. A diamond like carbon (DLC) layer 63 is deposited on the patterned gold layer 62, the tantalum layer 61 and over the exposed portions of the composite passivation layers 59 and 60 except that portions of the DLC layer 63 are removed in those areas where resistors 56 and the gold contact pads 71 are formed, and functions as an adhesion layer in areas where it is in contact with the barrier layer 12. Thus, to the extent that DLC to barrier adhesion is desired in the vicinity of the ink chambers and ink channels, the interface between the diamond like carbon layer 63 and the barrier 12 can extend for example from at least the region between the resistors 56 to the ends of the barrier tips 12*a*. To the extent that the increased resistivity of DLC in the gold bond pads 71 (FIG. 1) is not suitable, the DLC can be etched from the gold bond pads 71.

Figure 5:
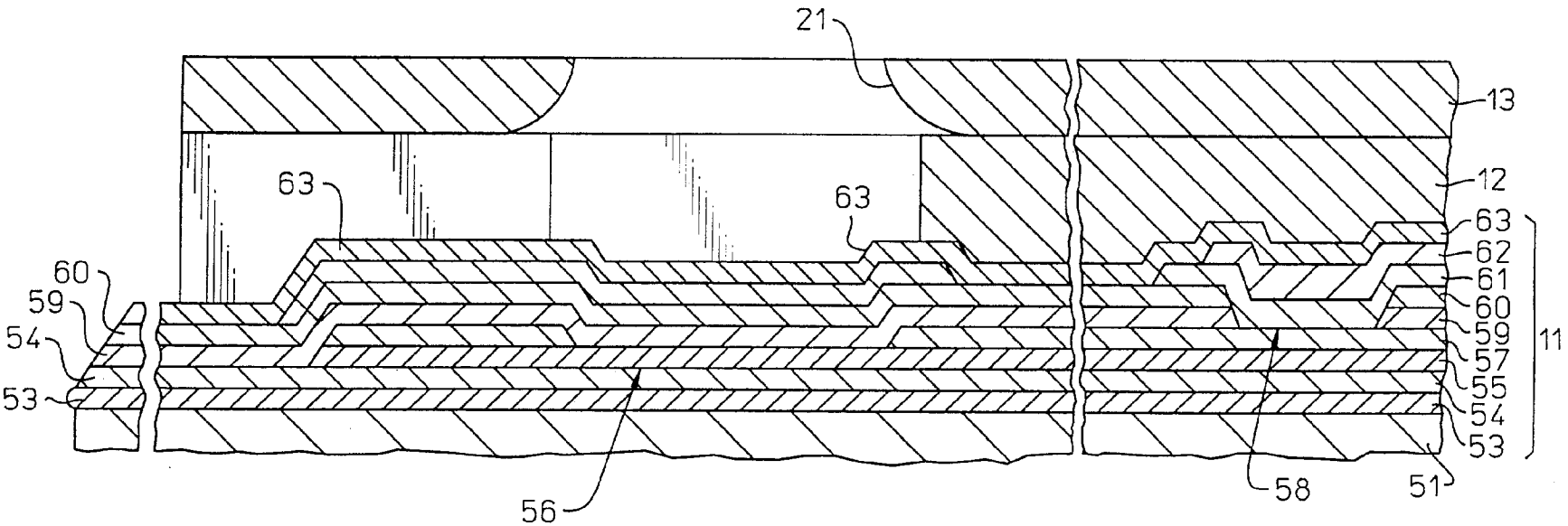
FIG. 5 is an unscaled schematic cross sectional view of the ink-jet printhead of FIG. 1 taken laterally through a representative ink drop generator region and illustration another embodiment of the printhead of FIG. 1.

Referring now to FIG. 5, set forth therein is an unscaled schematic cross sectional view of the ink-jet printhead of FIG. 1 taken through a representative ink drop generator region and a portion of the centrally located gold layer region 62, and illustrating another embodiment of the thin film substrate 11. The ink-jet printhead of FIG. 5 is substantially the similar to the ink-jet printhead of FIG. 4 with the following exception. The DLC layer 63 is deposited on the patterned gold layer 62, the tantalum layer 61 and over the exposed portions of the composite passivation layers 59 and 60 including those areas where resistors are formed. This embodiment improves the resistance of the resistor areas to ink and furthermore, eliminates the photomasking and etching step in the manufacturing process. To the extent that the increased resistivity of DLC in the gold bond pads 71 (FIG. 1) is not suitable, the DLC can be etched from the gold bond pads 71.

Figure 6:
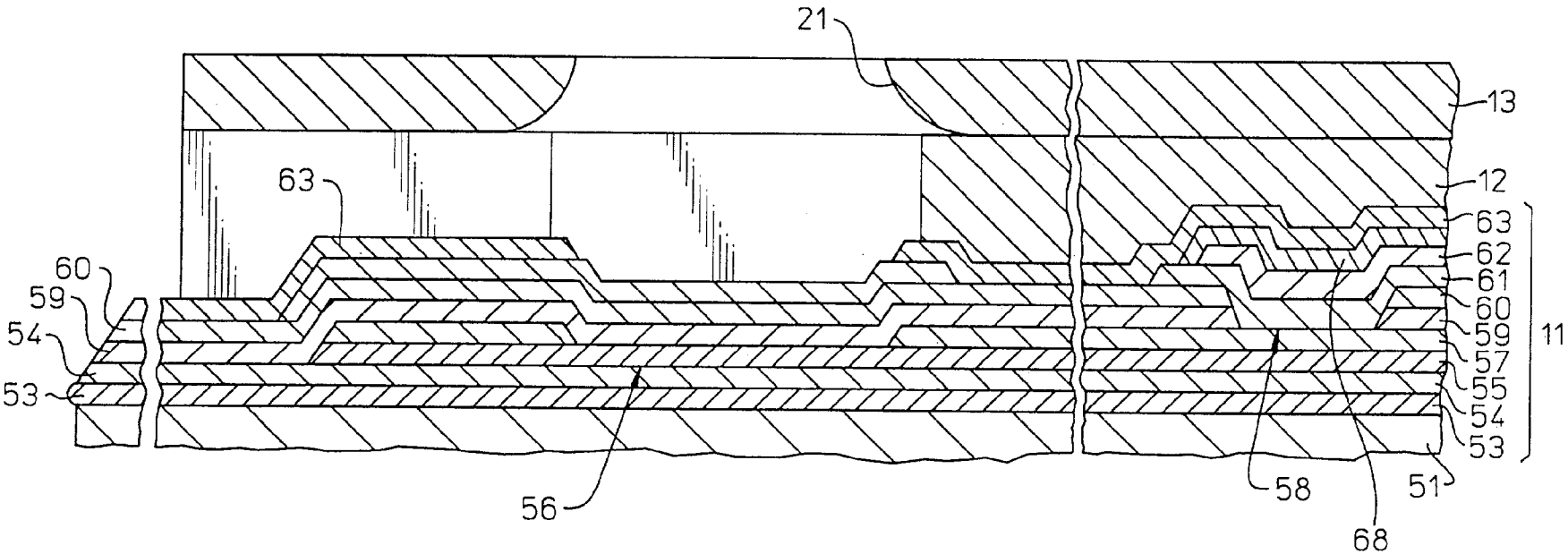
FIG. 6 is an unscaled schematic cross sectional view of the ink-jet printhead of FIG. 1 taken laterally through a representative ink drop generator region and illustration an embodiment of the printhead of FIG. 1 that is similar to the embodiment of FIG. 4 with the addition of an intervening adhesion promoter layer.

Referring now to FIG. 6, set forth therein is an unscaled schematic cross sectional view of the ink jet printhead of FIG. 1 taken through a representative ink drop generator region and a portion of the centrally located gold layer region 62, and illustrating another embodiment of the thin film substrate 11. The ink-jet printhead of FIG. 6 is substantially the similar to the ink-jet printhead of FIG. 4 with the following exception. There is an adhesion promoter layer 68 positioned between the gold patterned layer 62 and the DLC layer 63 for bonding the gold layer 62 and DLC layer 63. Examples of commonly used gold adhesion promoters are cited in patents, such as U.S. Pat. No. 4,497,890, and include, but are not limited to: 2-(diphenylphosphino)ethyltriethoxysilane, trimethylsilylacetamide, bis[3-(triethoxysilyl)propyl]tetrasulphide, and 3-mercaptopropyltriethoxysilane.

Figure 7:
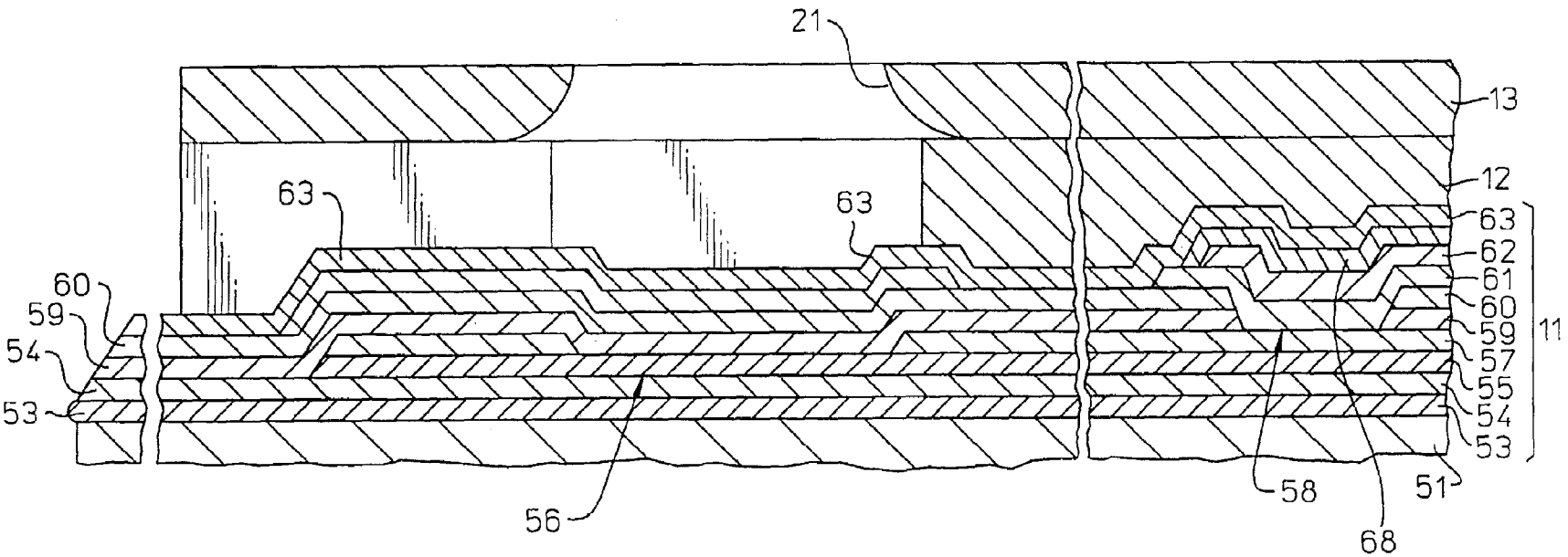
FIG. 7 is an unscaled schematic cross sectional view of the ink-jet printhead of FIG. 1 taken laterally through a representative ink drop generator region and illustration an embodiment of the printhead of FIG. 1 that is similar to the embodiment of FIG. 5 with the addition of an intervening adhesion promoter layer.

Referring now to FIG. 7, set forth therein is an unsealed schematic cross sectional view of the ink-jet printhead of FIG. 1 taken through a representative ink drop generator region and a portion of the centrally located gold layer region 62, and illustrating another embodiment of the thin film substrate 11. The ink-jet printhead of FIG. 7 is substantially the similar to the ink-jet printhead of FIG. 5 with the following exception. There is an adhesion promoter layer 68 positioned between the gold patterned layer 62 and the DLC layer 63 for bonding the gold layer 62 and DLC layer 63. Examples of commonly used gold adhesion promoters are cited in patents, such as U.S. Pat. No. 4,497,890, and include, but are not limited to: 2-(diphenylphosphino)ethyltriethoxysilane, trimethylsilylacetamide, bis[3-(triethoxysilyl)propyl]tetrasulphide, and 3-mercaptopropyltriethoxysilane.

The foregoing printhead is readily produced pursuant to standard thin film integrated circuit processing including chemical vapor deposition, photoresist deposition, masking, developing, and etching, for example as disclosed in commonly assigned U.S. Pat. No. 4,719,477 and U.S. Pat. No. 5,317,346, both previously incorporated herein by reference.

By way of illustrative example, the foregoing structures can be made as follows. Starting with the silicon substrate 51, any active regions where transistors are to be formed are protected by patterned oxide and nitride layers. Field oxide 53 is grown in the unprotected areas, and the oxide and nitride layers are removed. Next, gate oxide is grown in the active regions, and a polysilicon layer is deposited over the entire substrate. The gate oxide and the polysilicon are etched to form polysilicon gates over the active areas. The resulting thin film structure is subjected to phosphorous predeposition by which phosphorous is introduced into the unprotected areas of the silicon substrate. A layer of phosphorous doped oxide 54 is then deposited over the previously entire in-process thin film structure, and the phosphorous doped oxide coated structure is subjected to a diffusion drive-in step to achieve the desired depth of diffusion in the active areas. The phosphorous doped oxide layer is then masked and etched to open contacts to the active devices.

The tantalum aluminum resistive layer 55 is then deposited, and the aluminum metallization layer 57 is subsequently deposited on the tantalum aluminum layer 55. The aluminum layer 57 and the tantalum aluminum layer 55 are etched together to form the desired conductive pattern. The resulting patterned aluminum layer is then etched to open the resistor areas.

The silicon nitride passivation layer 59 and the SiC passivation layer 60 are respectively deposited. A photoresist pattern which defines vias to be formed in the silicon nitride and silicon carbide layers 59, 60 is disposed on the silicon carbide layer 60, and the thin film structure is subjected to overetching, which opens vias through the composite passivation layer comprised of silicon nitride and silicon carbide to the aluminum metallization layer.

As to the implementation of FIGS. 4 and 5, the tantalum layer 61 is deposited, with the gold metallization layer 62 subsequently deposited thereon. The gold layer 62 and the tantalum layer 61 are etched together to form the desired conductive pattern. The resulting patterned gold layer is then etched to form the conductive paths 58.

Terms such as DLC, diamond-like carbon, amorphous carbon, a-C, a-C:H, are used to designate a class of films which primarily consist of carbon and hydrogen. The structure of these films is considered amorphous; that is, the films exhibit no long-range atomic order, or equivalently, no structural correlation beyond 2–3 nanometers. The carbon bonding in these films is a mixture of $sp^2$ and $sp^3$, with usually a predominance of $sp^3$ bonds.

The carbon rich layer of the present invention comprises at least 25% elemental carbon, more preferably, from about 35% to about 100% elemental carbon, and most preferably, from about 75% to about 100% elemental carbon. The DLC layer of the present invention typically has an $sp^2$ to $sp^3$ ratio in the range from about 1:1.5 to about 1:9, more preferably, from about 1:2.0 to about 1:2.4, and most preferably, from about 1:2.2 to about 1:2.3.

The DLC layer 63 is formed by way of one of several common techniques described extensively in literature references such as J. Robertson, "Surface and Coatings Tech., Vol. 50 (1992), page 185; M. Weiler et al, Physical Review B Vol. 53, Number 3, page 1594; Tamor et al, Applied Physics Letters, Vol. 58, no. 6 page 592; and Shroder et al, Physical Review B, Vol. 41, number 6, page 3738 (1990); all incorporated herein by reference. These techniques include microwave plasma, radio-frequency (r.f.) and glow discharge, hot filament, ion sputtering, ion beam deposition and laser ablation, using hydrocarbon gases or carbon as starting materials. DLC films can also be deposited by plasma enhanced chemical vapor deposition (PECVD) techniques. The PECVD method usually does not employ a solid form of carbon as the source material but rather carbon containing gases or vapors (such as methane and acetylene) which are decomposed in a glow discharge ("plasma").

By way of illustrative example, the foregoing DLC layer 63 can be made as follows. The substrate 11 is inserted into a PECVD chamber. The chamber is then evacuated and a gas, such as argon, and a carbon containing gas, such as methane, is introduced into the chamber in such amounts to achieve the desired flow rate and partial pressures. Power is delivered to the power electrode. The power is maintained for a certain length of time to allow for deposition of the DLC on the substrate 11. After completion of the deposition, the power is turned off and the chamber is evacuated of the gases. The chamber is then vented with a gas such as argon or nitrogen and the substrate with the deposited DLC layer is removed from the chamber. In one specific embodiment of the process employed for the deposition of the DLC layer 63, a PECVD parallel-plate reactor (available from Surface Technology Systems, Newport, Gwent, Wales, United Kingdom) was employed. The system consisted of a grounded electrode, to which the silicon wafer was attached, separated by 50 mm from a second, powered electrode (300 mm diameter). The RF power, deposition times, and the partial pressures of the methane and argon gases were varied to obtain DLC films with various physical properties in order to effectuate desirable adhesion properties between the substrate 11 and the subsequently deposited barrier layer 12. Desirable properties can be measured by way of placing completed pens into an elevated temperature environment and observing adhesion of the barrier to the DLC —or—by taking coupons with the DLC and barrier film and placing them in an ink solution at elevated temperature and humidity and observing the adhesion strength of the interfacial bond. It should be noted that any of the aforementioned deposition techniques are suitable for obtaining DLC films and, in principle, can be utilized. In addition, the PECVD process outlined here is not limited to methane and argon gas mixtures or parallel-plate reactors. Any carbon-containing gas mixture in any PECVD reactor such as asymmetric plates, and ECR chamber (Electron Cyclotrone Resonance) that is capable of forming DLC can be used.

After forming the DLC layer 63, the barrier layer 12 is added using standard electronics manufacturing techniques, for example as disclosed in commonly assigned U.S. Pat. No. 4,719,477 and U.S. Pat. No. 5,317,346, both previously incorporated herein by reference. Optionally, oxygen-plasma etching may be utilized, using the barrier layer 12 as a mask to remove the DLC layer 63 from areas not protected by the barrier layer 12. Alternatively, after the deposition of the DLC layer 63, the DLC layer 63 is masked using standard photoresist processes. Thereafter, the undesired areas of the layer are etched, followed by the stripping of the photoresist and finally the addition of the barrier layer 12.

As to the implementation of the adhesion promoter layer 68 in FIGS. 6 and 7 this can be accomplished by one of several commonly used techniques. Examples of such techniques include, submersion of parts in a liquid containing said promoter, or spray coating of parts with said promoter either in pure or diluted form, or vapor priming of said promoter.

The adequacy of the adhesion between the barrier layer 12 and the substrate 1 comprising the DLC layer 63 was tested by exposing the printhead 100 to accelerated operating conditions, such as exposure to ink, and thereafter measuring the adhesion between the barrier layer 12 and the substrate 11, using standard analytical techniques. It was found that printheads having the DLC layer 63 demonstrated enhanced adhesion as compared to those without the DLC layer 63.

DETERMINING THE PRESENCE OF DLC LAYER

Determination of the presence of a DLC layer can be accomplished using one or both of the following techniques:

1. RAMAN analysis of the suspected DLC surface will give specific carbon state information; and
2. Observation of chemical attack of the underlying thin film structures using the following technique:
   a) Measure the samples using XPS or similar means to determine if there is a carbon rich layer (suspected DLC) on the surface of the sample.
   b) Place the sample with the suspected DLC layer into a mixture of sulfuric acid and hydrogen peroxide (piranha). Typical mixtures would be approximately 70% sulfuric acid and 30% hydrogen peroxide. This will remove any non-DLC carbon from the surface of the sample.
   c) Next, place the sample into an etchant that would normally attack the underlying thin film surface (eg. tantalum or gold).
   d) If DLC is present on the surface, little or no attack of the thin film material will be observed. If no attack of the underlying thin film is observed, there is a continuous DLC layer. If there is some level of attack there is a non-continuous DLC layer. If All of the underlying thin film material is removed, there is no DLC present.

EXAMPLES

Wafers were prepared using the above described techniques, in which on the underlying thin film surface, either a DLC layer was present or not. The adhesion strength of the interfacial bond between the thin film substrate and the ink barrier layer of the wafers was tested by immersing parts having uniform surface composition (e.g., blanket-coated) in ink and placing them in an autoclave at 117° C., 1.2 atmosphere, and thereafter, measuring adhesion on a semi-quantitative scale by attempting to scrape and peel the barrier layer from the substrate. The data in Table 1 illustrates typical results for adhesion over time using this test method:

TABLE 1

| | HOURS SOAKED IN INK | | | | | |
|---|---|---|---|---|---|---|
| UNDERLYING THIN FILM SURFACE | 2 | 4 | 8 | 16 | 24 | 63 |
| | ADHESION STRENGTH | | | | | |
| Ta control | fair | none | none | none | none | none |
| $CH_4$ plasma treated Ta | excellent | excellent | excellent | excellent | excellent | good |
| Au control | none | — | — | — | — | — |
| $CH_4$ plasma treated Au | — | — | — | — | fair | none |

As can be noted from the results in Table 1, thin films comprising a DLC layer, demonstrated superior adhesion strength between the barrier and the thin film substrate to those not having the DLC layer.

It should be appreciated that although specific embodiments of the invention have been described and illustrated, the invention is not to be limited to the specific forms or arrangement of parts so described and illustrated. The invention is limited only by the claims.

What is claimed is:

1. A thin film printhead, comprising:

a thin film substrate comprising a plurality of thin film layers, said thin film layers including a patterned gold layer;

a plurality of ink firing heater resistors defined in said plurality of thin film layers;

a polymer fluid barrier layer; and a diamond like carbon layer disposed on said plurality of thin film layers, with said polymer fluid barrier layer disposed directly on said diamond like carbon layer, said diamond like carbon layer bonding said polymer fluid barrier layer to said thin film substrate, such that said diamond like carbon layer is formed between said plurality of ink firing heater resistors and said polymer fluid barrier layer, said diamond like carbon layer extending over the patterned gold layer, the diamond like carbon layer formed both in those areas of said thin film layers that form said ink firing heater resistors and in those areas of said thin film layers that do not form said ink firing heater.

2. The thin film printhead of claim 1, further comprising an adhesion promoter layer between said diamond like carbon layer and said plurality of thin film layers.

3. The thin film printhead of claim 1, wherein said diamond like carbon layer comprises at least 25% elemental carbon.

4. The thin film printhead of claim 3, wherein said diamond like carbon layer comprises from about 35% to about 100% elemental carbon.

5. The thin film printhead of claim 4, wherein said diamond like carbon layer comprises from about 75% to about 100% elemental carbon.

6. The thin film printhead of claim 1, wherein the diamond like carbon layer comprises carbon having an $sp^2$ to $sp^3$ ratio m the range from about 1:1.5 to about 1:9.

7. The thin film printhead of claim 6, wherein the diamond like carbon layer comprises carbon having an $sp^2$ to $sp^3$ ratio in the range from about 1:2.0 to about 1:2.4.

8. The thin film printhead of claim 7, wherein the diamond like carbon layer comprises carbon having an $sp^2$ to $sp^3$ ratio m the range from about 1:2.2 to about 1:2.3.

9. The thin film printhead of claim 1, wherein said diamond like carbon layer is formed by passing carbon containing gas over said substrate such that the diamond like carbon layer is formed on said substrate.

10. The thin film printhead of claim 9, wherein said carbon containing gas is methane.

11. The thin film printhead of claim 1, wherein said diamond like carbon layer is formed by a plasma enhanced chemical vapor deposition method.

12. The thin film printhead of claim 1, wherein the diamond like carbon layer formed in those areas of said thin film layers that do not form said ink firing heater resistors reduces delamination.

13. A thin film printhead, comprising:

a thin film substrate comprising a plurality of thin film layers, said thin film layers including a patterned gold layer;

a plurality of ink firing heater resistors defined in said plurality of thin film layers;

a polymer fluid barrier layer; and a diamond like carbon layer disposed on said plurality of thin film layers, with said polymer fluid barrier layer disposed directly on said diamond like carbon layer, said diamond like carbon layer bonding said polymer fluid barrier layer to said thin film substrate, such that said diamond like carbon layer is formed between said plurality of ink firing heater resistors and said polymer fluid barrier layer, said diamond like carbon layer extending over the patterned gold layer, the diamond like carbon layer formed both in those areas of said thin film layers that form said ink firing heater resistors and in those areas of said thin film layers that do not form said ink firing heater resistors;

said diamond like carbon layer having been formed by inserting said substrate into a plasma enhanced chemical vapor deposition chamber;

evacuating the chamber;

introducing into the chamber a noble gas and a carbon containing gas;

delivering power to the chamber;

maintaining power for a certain length of time sufficient to allow for formation of said carbon layer on said substrate;

evacuating the chamber;

venting the chamber with a noble gas;

removing said substrate with the deposited diamond like carbon layer from the chamber.

14. The thin film printhead of claim 13, wherein the plasma enhanced chemical vapor deposition chamber is a parallel plate chamber.

15. A thin film printhead, comprising:

a thin film substrate comprising a plurality of thin film layers, said thin film layers including a patterned gold layer;

a plurality of ink ejection elements defined in said plurality of thin film layers;

a polymer fluid barrier layer; and a diamond like carbon layer disposed on said plurality of thin film layers, with said polymer fluid barrier layer disposed directly on said diamond like carbon layer, said diamond like carbon layer bonding said polymer fluid barrier layer to said thin film substrate, such that said diamond like carbon layer is formed between said plurality of ink firing heater resistors and said polymer fluid barrier layer, said diamond like carbon layer extending over the patterned gold layer, the diamond like carbon layer formed both in those areas of said thin film layers that form said ink firing heater resistors and in those areas of said thin film layers that do not form said ink firing heater resistors.

* * * * *